United States Patent [19]

Theisen et al.

[11] Patent Number: 5,004,874

[45] Date of Patent: Apr. 2, 1991

[54] DIRECT CURRENT SWITCHING APPARATUS

[75] Inventors: Peter J. Theisen, West Bend; Daniel A. Wycklendt, Milwaukee; Mark A. Juds, New Berlin; Peter K. Moldovan, Cascade, all of Wis.

[73] Assignee: Eaton Corporation, Cleveland, Ohio

[21] Appl. No.: 435,228

[22] Filed: Nov. 13, 1989

[51] Int. Cl.[5] ..... H01H 33/04; H01H 33/18

[52] U.S. Cl. ..... 200/144 R; 200/147 R; 200/147 A

[58] Field of Search ..... 200/147 R, 144 R, 147 A

[56] References Cited

U.S. PATENT DOCUMENTS

| | | | |
|---|---|---|---|
| 2,506,991 | 5/1950 | Brown | 200/147 |
| 2,945,109 | 7/1960 | Fehling | 200/147 |
| 3,040,217 | 6/1962 | Conrad | 317/172 |
| 3,090,854 | 5/1963 | Kretzschmar | 200/147 |
| 4,082,931 | 4/1978 | Hayes | 200/144 C |
| 4,404,443 | 9/1983 | Coynel et al. | 200/147 A |

OTHER PUBLICATIONS

Theisen et al., "270-V DC Hybrid Switch", IEEE Transactions on Components, Hybrids and Manufacturing Technology, vol. CHMT-9, No. 1, Mar. 1986, (pp. 97-100).

Lukomski et al., "Characteristics of High Current Arcs Between Insulating Chute Materials", IEEE Transactions on Components, Hybrids, and Manufacturing Technology, vol. CHMT-6, pp. 32-36, Mar. 1983, (Typewriten format submitted, pp. 119-125).

*Primary Examiner*—Robert S. Macon

*Attorney, Agent, or Firm*—L. G. Vande Zande

[57] ABSTRACT

Direct current switching apparatus having two arc extinguishing chambers each comprising a pair of spaced conductors providing cooperable arc runners divergent toward a row of non-ferromagnetic splitter plates and a stationary contact conductively mounted on one conductor, the stationary contacts of respective chambers being mounted on respectively opposite conductors, corresponding conductors in respective chambers being conductively connected to each other and to power terminals of the apparatus, permanent magnets applying a magnetic field across the respective chamber for moving an arc within the chamber, ferromagnetic plates providing flux return paths to optimize and maximize the magnetic field, a movable contact extending into each chamber bridging the stationary contacts and movable to separate from the stationary contacts, drawing an arc therebetween in each chamber, the arc in one chamber bridging the pair of conductors within that chamber establishing a circuit comprising the arc between the conductors and the power terminals in shunt of the movable contact, thereby eliminating the arc in the other chamber, the bridging arc being extinguished in the splitter plates, interrupting the circuit. The magnetic fields are applied in opposite directions in the respective chambers for non-polarized operability of the apparatus and are distorted within the splitter plate area to drive and maintain an arc at a stable arc position against a thickened sidewall portion to withstand erosion.

27 Claims, 9 Drawing Sheets

8
58
58b
42
62
42
24
68b
64
58c
58c
42g
40g
44c
44c
40g
42g
60d
60d
16
48
48
48a
56
70e
68
70d
66
70e
90
102
98a
70c
40
100
100a
98
98c
94
88a
96
103
92
88b
88
84
74
86a
82
76
72
86a
74
104
86b
108
106
78
110
80
86
8

FIG 9
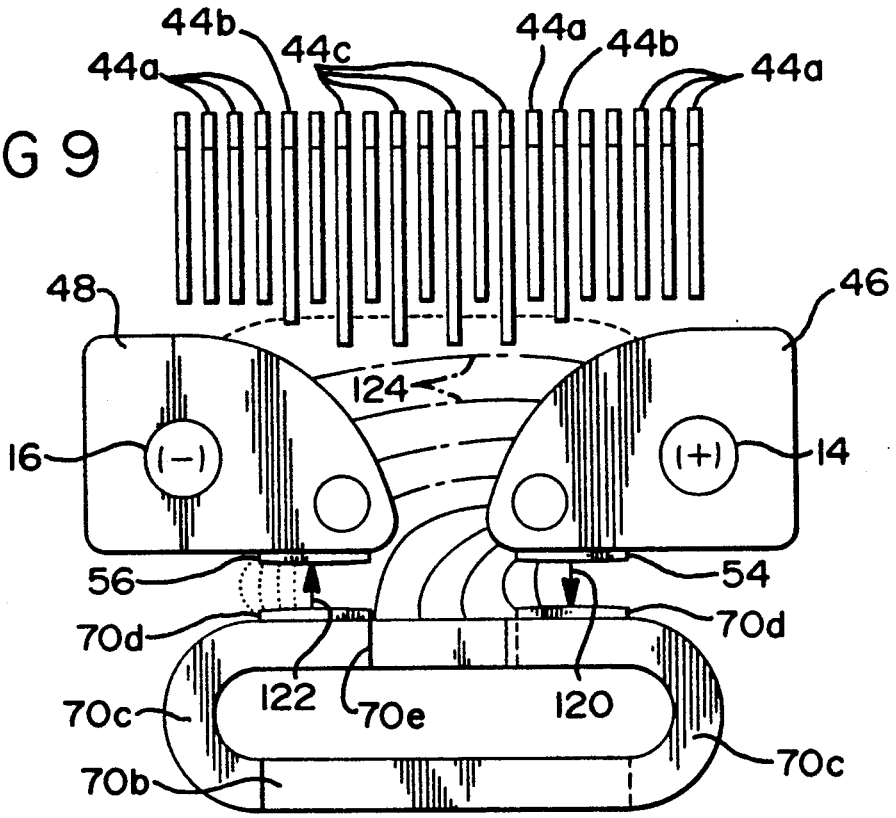
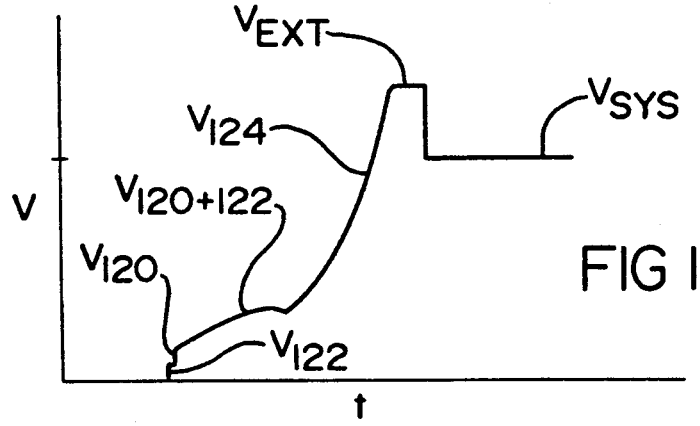
FIG 11
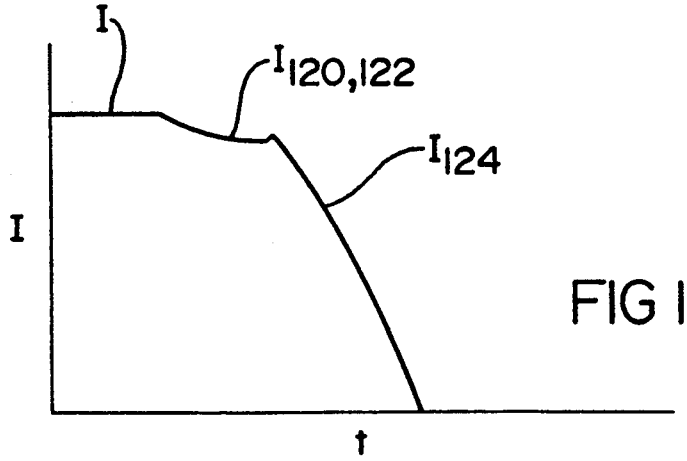
FIG 12

DIRECT CURRENT SWITCHING APPARATUS

BACKGROUND OF THE INVENTION

This invention relates to apparatus for switching direct current (DC) electric power. More particularly it relates to apparatus of the aforementioned type which is non-polarized or bidirectional, i.e. its performance is independent of polarity of the current at the power terminals, and can switch high voltage DC power. Still more particularly, the invention is related to apparatus of the aforementioned type which is compact, lightweight, may be hermetically sealed and can switch high voltage DC power at high altitude.

High voltage DC power is one of the most efficient, reliable and lightweight methods to generate and distribute energy. Development of high torque samarium cobalt brushless DC motors has resulted in low weight alternatives to hydraulic actuators used in weight and reliability-sensitive applications, e.g. aircraft. However, difficulties in switching high voltage DC power, particularly at high altitude, and the weight and volume of conventional DC switching apparatus capable of quenching high voltage circuits at altitudes, preclude the use of such switching apparatus in aircraft. As a result, the inability to satisfactorily switch high voltage DC power at altitude has delayed use of this power in aircraft.

SUMMARY OF THE INVENTION

It is an object of this invention to provide improved DC switching apparatus.

It is a further object of this invention to provide DC switching apparatus capable of switching high voltage DC power.

It is a further object of this invention to provide DC switching apparatus which is non-polarized.

It is a further object of this invention to provide DC switching apparatus capable of switching high voltage DC power at high altitude.

It is still a further object of this invention to provide DC switching apparatus capable of switching high voltage DC power at high altitude, which apparatus is compact and lightweight.

It is still a further object of this invention to provide DC switching apparatus of the aforementioned type which is economically and efficiently manufactured.

This invention provides DC switching apparatus comprising a pair of arc extinguishing chambers each having a spaced pair of conductors, the respective conductors of one chamber conductively connected to the respective corresponding conductors of the other chamber and to respective power terminals of the apparatus, a pair of stationary contacts, one of which is conductively mounted on one of the conductors in one chamber and the other of which is conductively mounted on an opposite one of the conductors in the other chamber, and a movable contact extending into each chamber and driven into and out of bridging engagement with the pair of stationary contacts, movement of the bridging contact out of engagement with the stationary contacts establishing respective arcs therebetween, a first arc transferring from the movable contact to the other conductor within a chamber establishing a current path comprising the arc directly between the first and second conductors, eliminating a second arc in the other chamber.

This invention further provides permanent magnets providing magnetic fields across the arc chambers normal to the arc for assisting the mobility of the arc, the magnetic fields being oppositely directed across the respective chambers providing non-polarized apparatus; return flux paths for maximizing and/or optimizing the magnetic fields applied by permanent magnets; arc runners as a part of the pair of conductors within each chamber to direct the arc into a plurality of arc splitter plates also contained within each chamber; a predetermined distortion of the magnetic field in the splitter plate area of each arc extinguishing chamber which drives and holds the arc at a final stable position against a wall of the chamber within the splitter plates.

The foregoing and other features and advantages of this invention will become more readily apparent and understood when reading the following description and appended claims in conjunction with the drawings.

BRIEF DESCRIPTION OF THE DRAWINGS

FIG. 9 is a view similar to FIG. 8, but showing only the contact, arc runner and splitter plate structure of this invention, illustrating arc movement within the chamber;

FIG. 11 is a graph of voltage of the apparatus at current interruption; and

FIG. 12 is a graph of current during interruption thereof within the apparatus of this invention.

DETAILED DESCRIPTION OF THE PREFERRED EMBODIMENT

Figure 1:
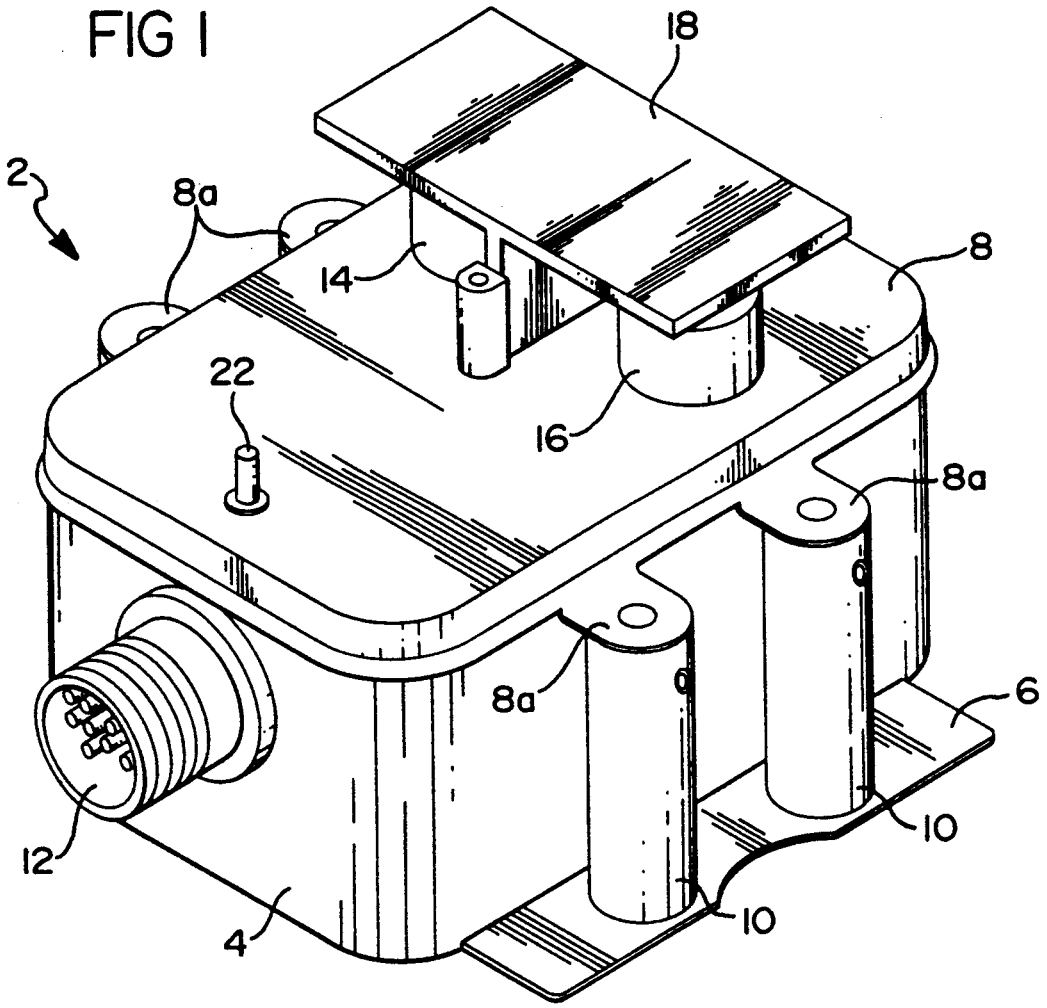
FIG. 1 is an isometric view of a hermetically sealed electromagnetic contactor comprising the DC switching apparatus of this invention oriented, for purposes of the following description only, on its backside with a front side disposed upward and a multipin connector extending from a bottom side thereof.

With reference to FIG. 1 of the drawings, a hermetically sealed electromagnetic contactor 2 incorporating the DC switching apparatus of this invention is shown in isometric. The contactor 2 comprises an outer metal envelope comprising a can 4 having a mounting plate 6 affixed to the back thereof by welding or the like and a header 8 hermetically welded over an open front side of can 4. As a reference for the term "compact " as used herein, the envelope comprising can 4 and header 8 may be on the order of 3.42 inches wide by 5.00 inches long by 3.23 inches high. Header 8 has outwardly projecting flanges 8*a* extending from opposite lateral edges. A pair of stabilizing tubes 10 are secured between mounting plate 6 and flanges 8*a*, only one pair of tubes 10 being visible in FIG. 1. Tubes 10 are closed at the forward end and riveted to flanges 8*a* and are secured to the mounting plate 6 at their opposite ends over holes in the plate 6.

A multipin connector 12 is hermetically attached within an opening in a bottom wall of can 4 to provide connection to control electronics for the DC switching apparatus within the envelope as will be described hereinafter. DC power terminals 14, 16 are attached and hermetically sealed to header 8, electrical insulated therefrom, to extend through the header. The externally projecting portions of terminals 14, 16 have tapped holes for receiving screws (not shown) which attach power conductors (not shown) to the terminals. A generally T-shaped insulating barrier 18 is attached to header 8 by a pair of screws 20 (FIG. 3) which threadably engage tapped sleeves welded to the exterior of header 8. Barrier 18 isolates the power terminals 14, 16 and conductors from each other and provides a protective cover thereover to reduce electrical shock hazard. Header 8 is also provided with a tubular fitting 22 through which the seal of the contactor assembly may be checked and may be evacuated and filled with a controlled atmosphere medium such as an inert gas or the like, after which the fitting 22 is crimped shut and sealed.

Figure 2:
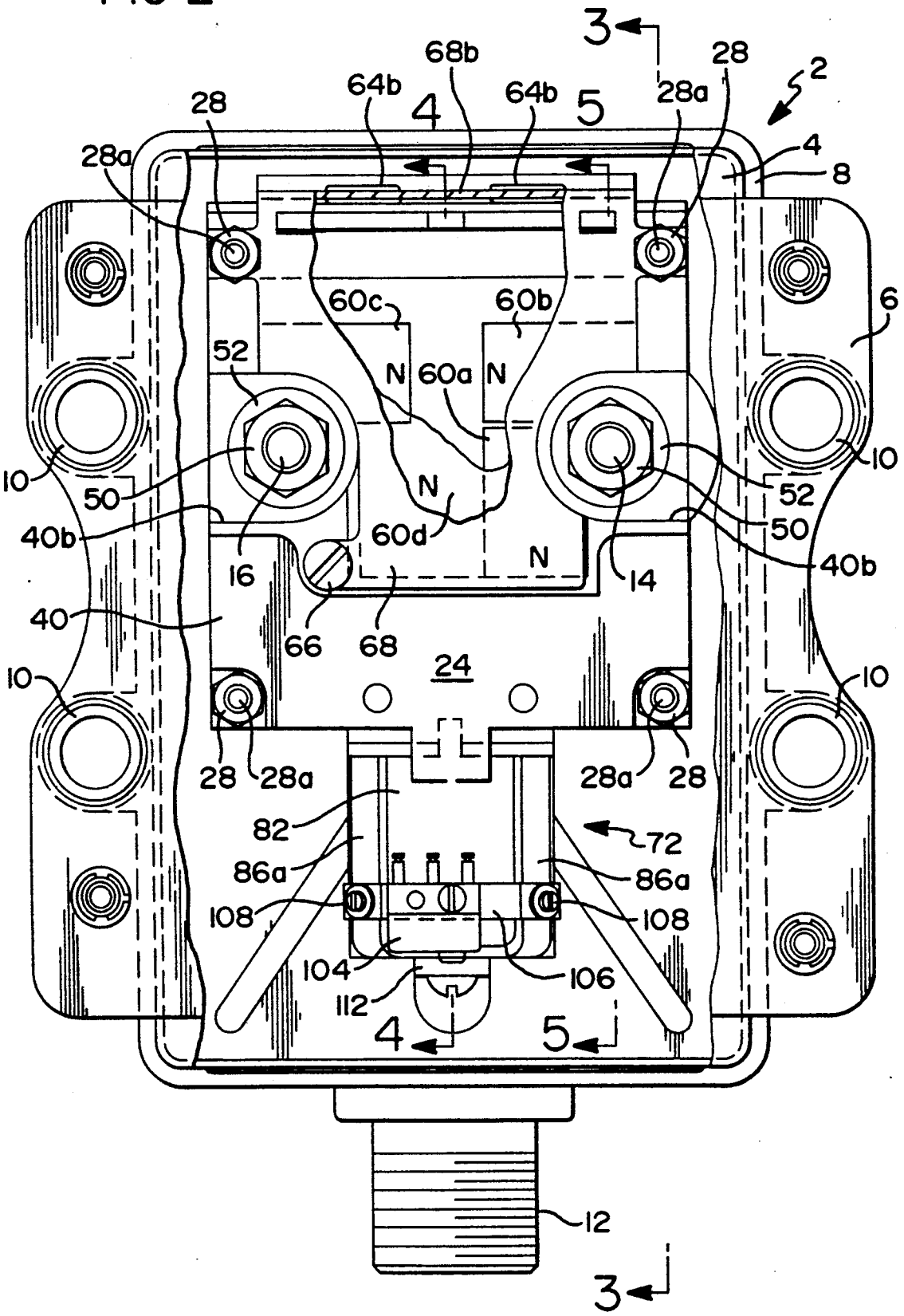
FIG. 2 is a back view of the contactor shown in FIG. 1 with the outer envelope broken away to expose the DC switching apparatus of this invention.
Figure 3:
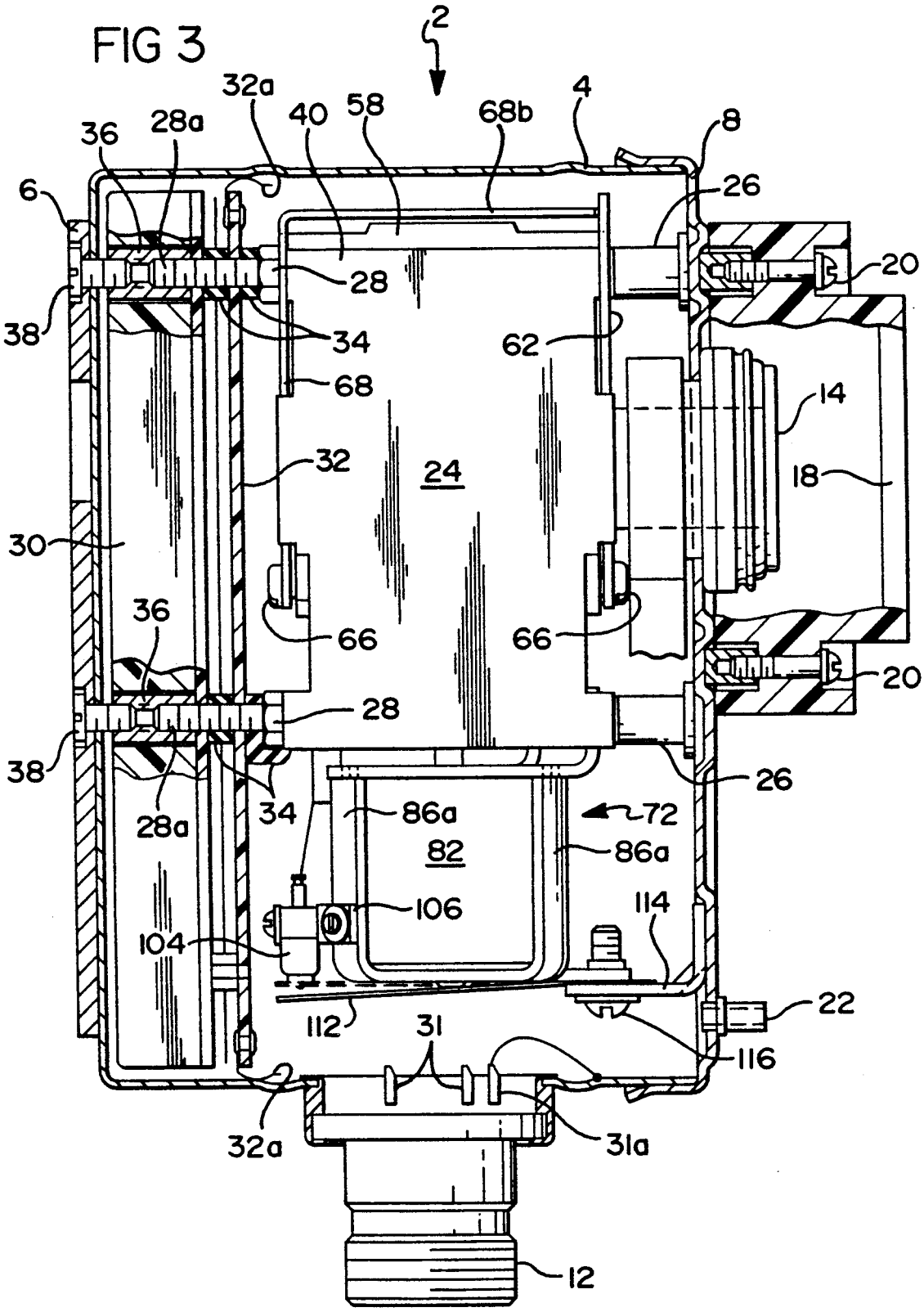
FIG. 3 is a cross section of the contactor of FIGS. 1 and 2 taken generally along the line 3—3 in FIG. 2.

Referring to FIGS. 2 and 3, the DC switching apparatus represented generally by the reference numeral 24, is built up upon and attached to the interior of header 8 prior to assembly of the external envelope members 4 and 8. Four internally tapped posts 26 (two visible in FIG. 3) are welded to header 8. Four mounting screws 28 pass through the switching apparatus assembly 24 from the rear to threadably engage posts 26, securing apparatus 24 to header 8. Screws 28 also have threaded post extensions 28*a* extending rearwardly from hexagonal heads thereof to which a control electronics module 30 and an electromagnetic interference (EMI) shield 32 are mounted. EMI shield 32 is spaced from module 30 and the hexagonal heads of screws 28 by rubber spacers 34. Cylindrical nuts 36, having a tapped hole therethrough and a screw driver slot at the rear end, are inserted within holes in control module 30 and are turned onto the threaded post extensions 28*a*. Wires 31, partially shown in FIG. 3, extend from control module 30 and are connected, as by soldering or the like, to internal portions of the pin connectors of multipin connector 12. A wire 31*a* (FIG. 3) may be attached to an interior part of can 4 to electrically ground the envelope to the system in which the apparatus is used.

After assembly of header 8 with switching apparatus 24, EMI shield 32 and control electronics module 30 attached thereto, to can 4, screws 38 (FIG. 3) are turned into nuts 36 from the exterior of the envelope through aligned holes in mounting plate 6 and can 4 to firmly secure the electronics module and shield within the rear of the envelope. Screws 38 are subsequently sealed to mounting plate 6 by welding or the like. It may be seen in FIG. 3 that shield 32 is provided with resilient spring clips 32*a* at its top and bottom edges which engage the interior surface of metal can 4 to incorporate the metal envelope in the magnetic shielding of the electronics.

Switching apparatus 24 chiefly comprises two identical molded insulating housing assemblies disposed back-to-back, within which and to which other components of the apparatus are mounted to provide a pair of arc extinguishing chambers. Referring additionally to FIGS. 4–8, and particularly to FIG. 6, the molded insulating housing assemblies each comprise a three-sided molding 40 and a substantially flat cover molding 42 disposed over the open side of molding 40. The members 40 and 42 are symmetrical about a vertically disposed front-to-rear center plane, except for a minor deviation regarding mounting grooves for arc splitter plates. The interior wall surfaces of molding 40 and cover 42 have a plurality of grooves 40*g* and 42*g*, respectively, formed therein in closely spaced, parallel relation oriented vertically and extending in a row transverse to the front-to-rear center plane with regard to the directional orientation convention assigned in the description of FIG. 1 above. The grooves 40*g* and 42*g* are open at their upper ends and extend downwardly varying amounts as best seen in FIG. 8 to receive splitter plates 44 of correspondingly varying lengths 44*a*, 44*b* and 44*c*. Longer splitter plates 44*c* are located near the center of the housing assembly, spaced by interposed short plates 44*a*, thereby providing a wider initial entry space for an arc between the lower ends of plates 44*c*. Intermediate length plates 44*b* serve the same purpose as long plates 44*c*, but space provisions with the assembly prohibit another long plate 44*c* from being used at the locations of plates 44*b*. A vertical center line x—x is shown in FIG. 8 to illustrate that the location of plates 44*a*, 44*b* and 44*c* are not symmetrical about the line, inconsistent with most other details of the housing assembly. However, rotation of one housing assembly 180° about line x—x to place it back-to-back against the other housing assembly effects front-to-rear alignment or coincidence of the grooves 40*g* and 42*g* and plates 44 between the two housing assemblies, except that a long plate 44*c* in one housing will be aligned with a short plate 44*a* in the other housing, and similarly for intermediate length plates 44*b*. This nonsymmetry establishes a gap 45 between a splitter plate 44*c* and an adjacent conductor 46 which is greater than a corresponding gap 47 between conductor 48 and an adjacent splitter plate 44*c* as shown in FIG. 8 illustrating the rear chamber. The larger gap 45 is oppositely located in the forward chamber because that housing assembly is rotated 180° as aforedescribed. Reasons for the offset larger gaps will be described more fully hereinafter.

Covers 42 have circular slots 42*a* formed therein open to opposite lateral edges to receive a reduced diameter cylindrical center portion 46*a*, 48*a* machined into extruded teardrop shaped conductors 46, 48. The larger teardrop shaped portion of conductors 46, 48 are disposed between respective moldings 40 and covers 42 when the two housing assemblies are positioned back-to-back as described above. Moldings 40 have ledges 40*a* on their interior surfaces on which conductors 46, 48 rest for positioning the conductors therein. Moldings 40 also have holes 40*b* in the transversely extending wall thereof, holes 40*b* being axially aligned with the axes of slots 42*a* and of power terminals 14, 16. Conductors 46, 48 each have a hole extending longitudinally therethrough also on the axes of power terminals 14, 16, respectively. The power terminals have reduced diameter shafts 14*a*, 16*a* at the rear end thereof, the distal portions of which are threaded. Reduced diameter shafts 14*a*, 16*a* form annular shoulders on terminals 14, 16 against which a respective conductor 46, 48 abuts, being held tightly thereagainst in good electrical connection with the power terminals by nuts 50 engaging the threaded distal ends of shafts 14*a*, 16*a* and washers 52 interposed nuts 50 and conductors 46, 48 (see FIG. 5). Within the arc extinguishing chambers formed by moldings 40 and covers 42, the arcuate surfaces of the teardrop shaped conductors 46, 48 form diverging arc runners leading to the splitter plates 44. Completing the conductor assembly, stationary contact tips 54, 56 are affixed to the underside of the teardrop shaped conductors in good electrical conduction therewith, such as by brazing or the like. Stationary contact tip 54 is affixed to the underside of the rearmost teardrop shaped portion of conductor 46 which is disposed within the rear arc chamber and stationary contact tip 56 is affixed to the foremost teardrop shaped portion of conductor 48 which is disposed within the forward arc chamber for reasons that will be discussed more fully hereinafter.

Figure 5:
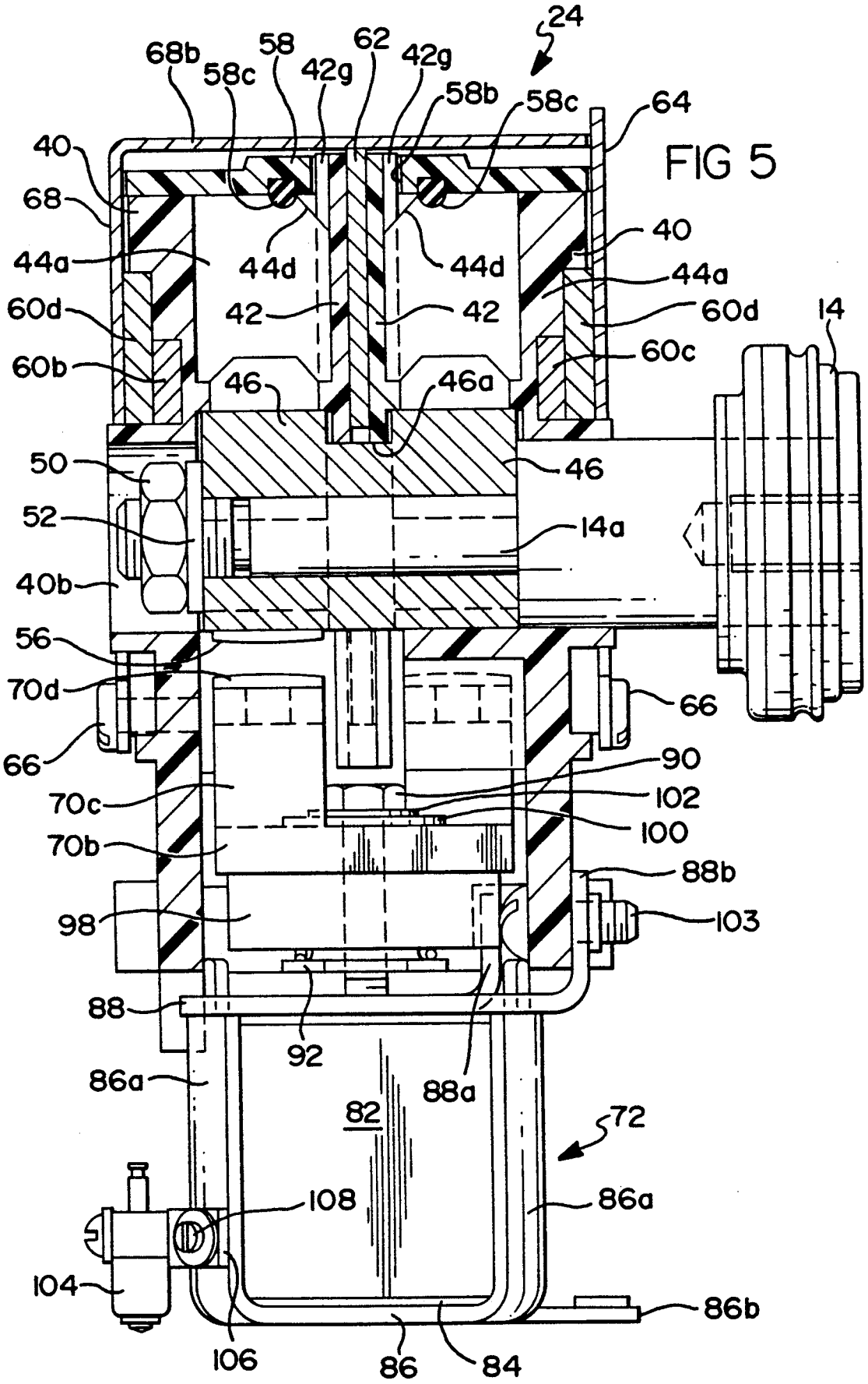
FIG. 5 is a cross section of the DC switching apparatus of this invention taken through one of the power terminal poles indicated generally along line 5—5 in FIG. 2.
Figure 6:
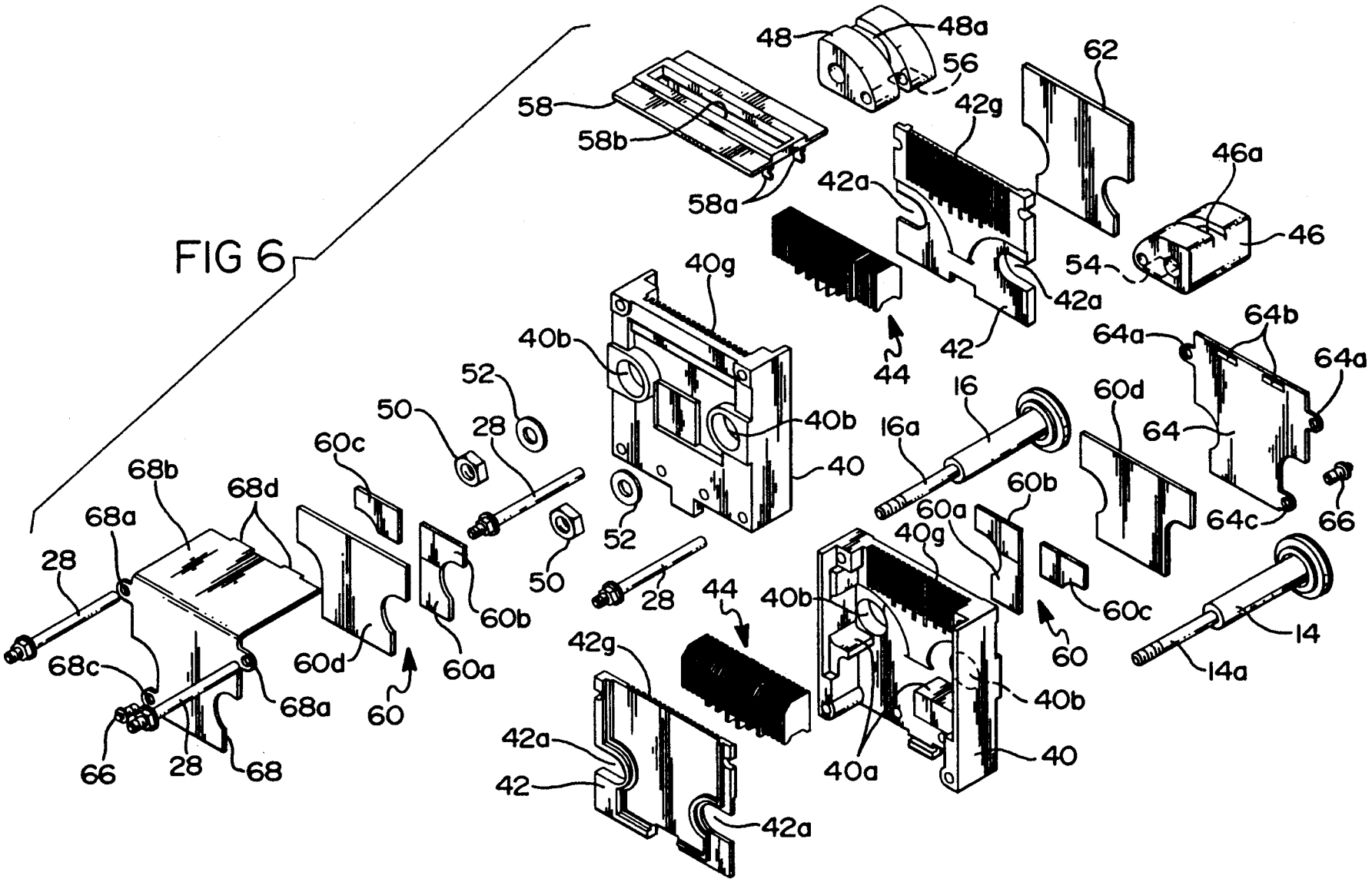
FIG. 6 is an exploded isometric view of the arc extinguishing chambers of the DC switching apparatus of this invention.

A molded insulating cover 58 is attached over the upper ends of the arc chamber housing assemblies when the latter are assembled back-to-back. Cover 58 has depending projections 58*a* at its lateral ends which have arcuate slots open laterally to be trapped by the uppermost pair of mounting screws 28 when the same are inserted through the switching apparatus. Cover 58 is also provided with an elongated central slot 58*b* (FIG. 5) extending therethrough and a pair of resilient strips 58*c* (FIG. 5) embedded in the underside thereof parallel to slot 58*b* and protruding downward from place, resilient strips 58*c* bear upon upper edges of splitter plates 44 to hold them firmly in place against lower edges of the respective grooves 40*g* and 42*g*. As seen best in FIG. 5, the opening 58*b* in cover 58 is disposed over the assembled upper edges of covers 42 and a center steel plate 62 to be described hereinafter. The interior edges defining slot 58*b* abut flush against the respective interior wall surfaces of covers 42 in which grooves 42*g* are formed. The grooves 42*g* are open to the upper edge of covers 42, and thereby define a plurality of vent openings for arc gas created within the respective chambers. With further reference to FIG. 5, it is to be noted that the upper edges of arc splitter plates 44 adjacent covers 42 are chamfered at 44*d* to create a reservoir area adjacent the vents for the arc gasses.

A plurality of permanent magnets 60 are positioned within appropriately shaped pockets in the external surface of the transversely extending wall of moldings 40 to provide a magnetic field across the respective chambers. In view of the magnetic field applied to the chambers, arc splitter plates are preferably made of non-ferromagnetic material such as copper or the like. The permanent magnets 60 are preferably rare earth magnets such as samarium cobalt to provide a strong magnetic field which will not vary with current magnitude. A plurality of magnets are used instead of one larger one to optimize the magnetic field, applying a minimum, or necessary, magnetic field intensity in specific areas without applying excessive and undesirable magnetic field intensity generally across the chamber. This multiple magnet feature also provides advantageous size and weight considerations. As seen best in FIG. 6, two magnets 60*a* and 60*b* are arranged with contiguous top and bottom edges respectively to circumscribe the holes 40*b* in moldings 40. A third magnet 60*c* is formed in a mirror image to magnet 60*b*. These three magnets 60*a*, 60*b* and 60*c* are first positioned within a deeper portion of a respective pocket molding 40, with magnets 60*b* and 60*c* being laterally spaced apart (see also FIG. 2). Magnet 60*a* is disposed in proximity to the respective stationary contact 54, 56 within the respective chamber. Magnets 60*b* and 60*c* are disposed in proximity of the ends of the arc runner surface of conductors 46, 48 adjacent arc splitter plates 44. Inasmuch as only one stationary contact is provided in each chamber, that being affixed to the respective right-hand conductor as viewed from the exterior of molding 40, a left-hand magnet corresponding to magnet 60*a* is not required. A fourth, larger magnet 60*d* is placed over all three smaller magnets and is positioned within a shallower portion of the pocket. The outline or profile of magnet 60*d* generally coincides with the outline of the assembled three magnets 60*a*, 60*b* and 60*c* except that it includes a lower-left portion substantially a mirror image of magnet 60*a*. All magnets 60 are polarized in the direction of their thickness and are arranged with north poles outwardly disposed, south poles facing the respective molding 40 in a magnetic series relationship.

Figure 10:
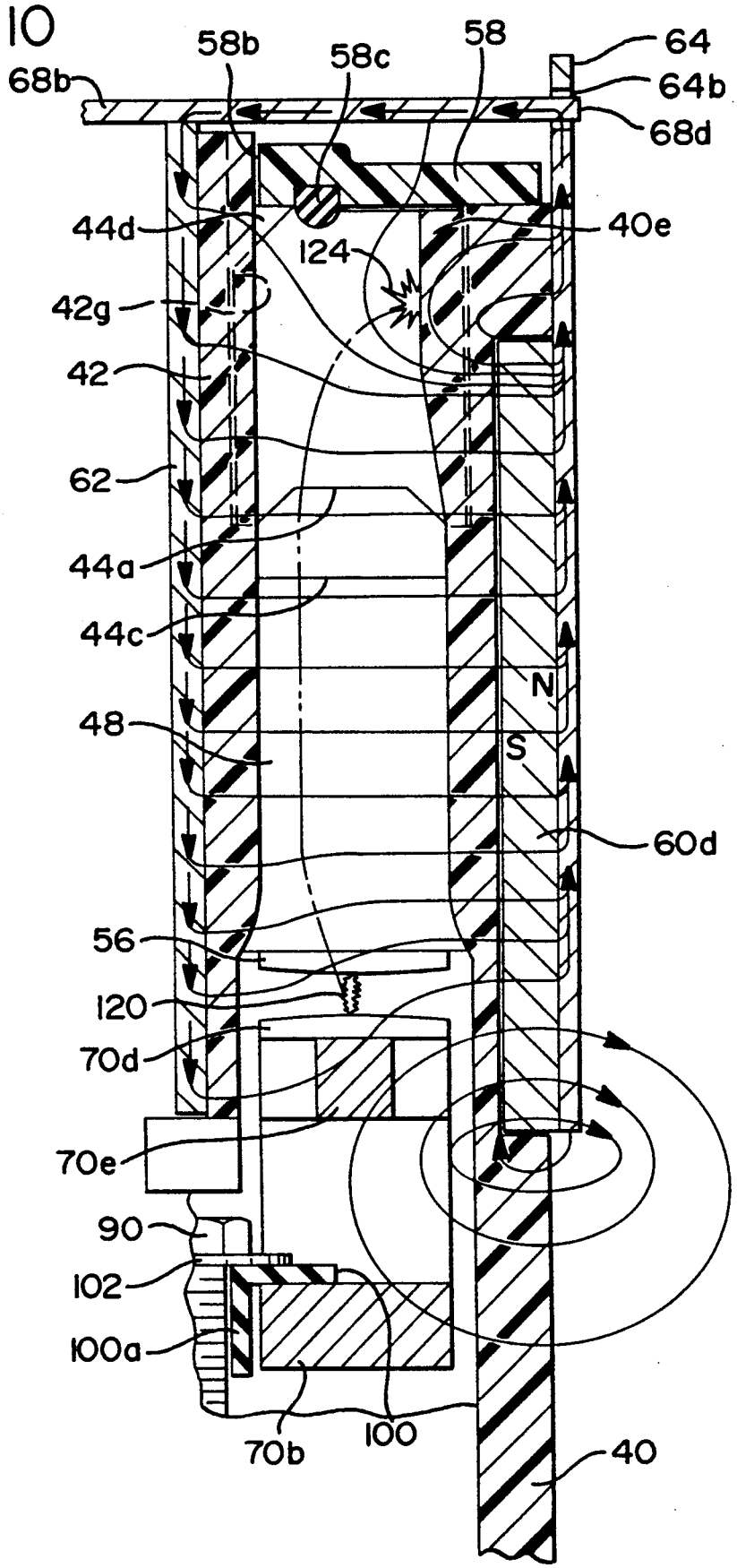
FIG. 10 is a cross section through the splitter plate area of an arc extinguishing chamber as seen in FIG. 4, but drawn to an enlarged scale and having magnetic field flux lines and a trajectory of an arc cross section superimposed thereon.

A ferromagnetic flux return path effectively completes the arc chamber assembly portion of the switching apparatus 24. A center steel plate 62 is disposed between adjacently disposed covers 42, projecting above the upper edges of the covers 42. A forward steel plate 64 having a profile similar to magnet 60*d*, but including a pair of laterally extending tabs 64*a* having holes therein and a pair of slots 64*b* along an upper edge, is positioned against the magnet 60*d* and exterior surface of forward molding 40, secured thereagainst by a screw 66 passing through a hole in a third laterally extending tab 64*c* and threading into an aligned hole in molding 40. A third member of the ferromagnetic flux return path is an inverted L-shaped steel plate 68, the vertical leg of which is shaped similarly to plate 64, having laterally extending tabs 68*a* and 68*c*, each with holes formed therethrough. A horizontal upper leg 68*b* of plate 68 has a pair of projecting tabs 68*d* along its distal edge. Plate 68 is positioned against the exterior surface of rearmost molding 40 and against the corresponding permanent magnet 60*d* and held thereagainst by a second screw 66 which extends through the hole in tab 68*c* and threadably engages an aligned hole in molding 40. Upper leg 68*b* projects forwardly over the housings and top cover 58, bearing against the upper edge of center steel plate 62, and interlocking with forward steel plate 64 by engagement of tabs 68*d* in slots 64*b*. Referring also to FIGS. 5 and 10, the permanent magnets 60 and ferromagnetic flux return path comprising steel plates 62, 64 and 68, direct a magnetic field across the respective arc chambers formed by moldings 40 and covers 42, the magnetic field in one chamber being reversed in direction with respect to the magnetic field in the other chamber. Center steel plate 62 is common to the flux return path around each chamber. Upper pair of screws 28 extend through holes in tabs 68*a* and 64*a* of steel plates 68 and 64, respectively, through aligned holes in moldings 40 and laterally open slots in covers 58*a*, respectively, to secure the entire upper area of the arc extinguishing chamber portion of switching apparatus 24 together as well as to hold apparatus 24 to header 8 as aforedescribed. Lower pair of screws 28 similarly hold the lower area of the arc chamber portion together, but extend only through aligned holes in moldings 40.

Figure 4:
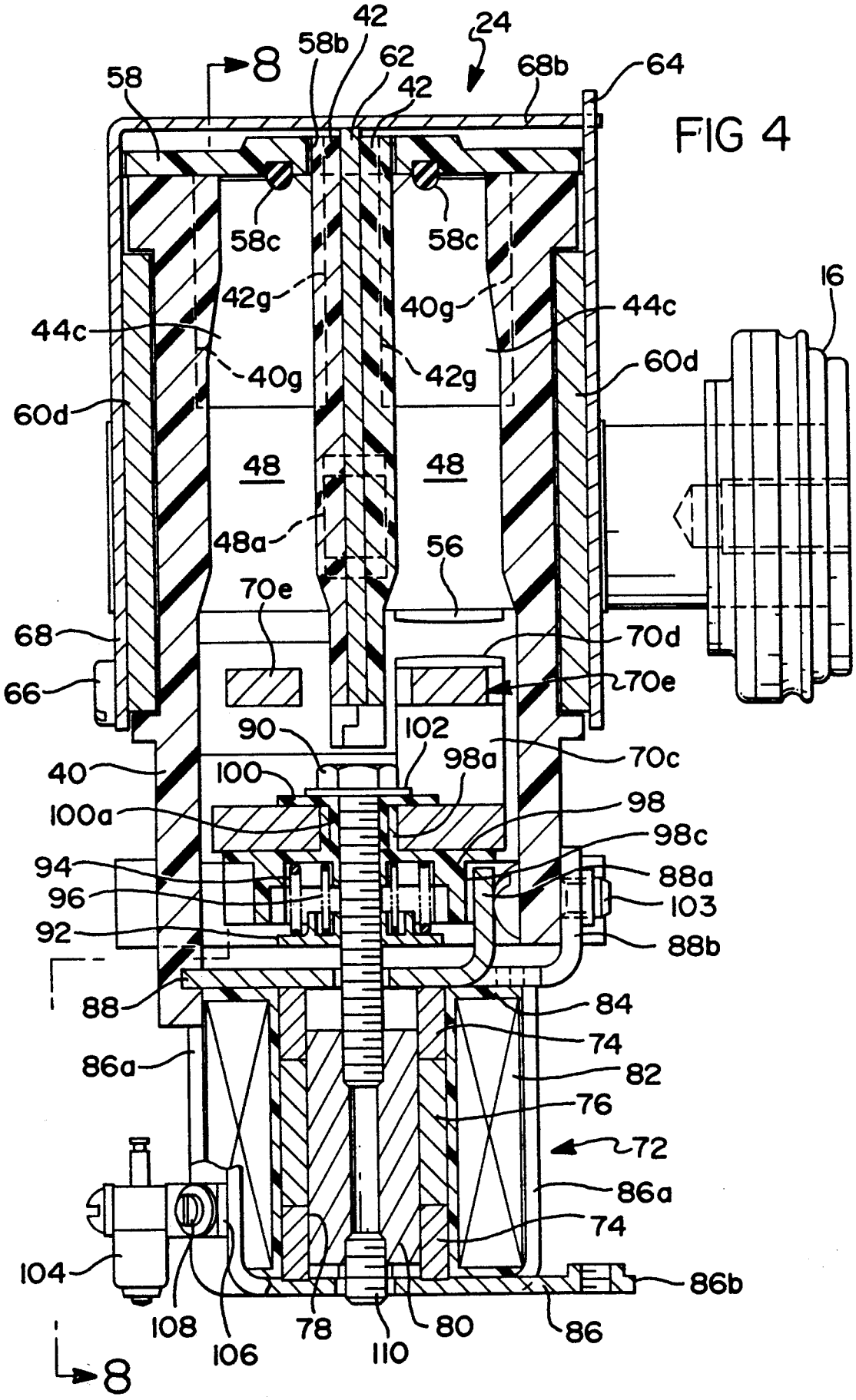
FIG. 4 is a cross section of the DC switching apparatus of this invention removed from the outer envelope taken generally along the line 4—4 in FIG. 2.

A movable bridging contact 70 (FIG. 7) is attached to the plunger of a latching permanent magnet actuator 72, shown best in FIG. 4. Actuator 72 is of the type shown and described in U.S. Pat. No. 3,040,217 issued June 19, 1962 to R. A. Conrad, the disclosure of which is incorporated herein by reference. Actuator 72 comprises a pair of cylindrical permanent magnets 74 polarized axially and disposed at opposite ends of a magnet steel cylindrical pole piece 76. Permanent magnets 74 are arranged with their north poles inward adjacent pole piece 76. A non-magnetic cylindrical plunger guide 78 lines the interior surface of holes through pole piece 76 and magnets 74, providing a guide for steel plunger 80 which is reciprocally movable axially within guide 78. A coil 82 wound on a bobbin 84 is disposed over the pole piece 76 and magnets 74. Alternatively, coil 82 may be two coils having opposite polarity concentrically disposed on bobbin 84. The assembly is secured together by a lower steel frame member 86 having four upstanding legs **86*a* extending along the exterior surface of coil 82, and an upper steel frame member 88 which has appropriately spaced slots to receive and secure the upper ends of legs 86*a*** therein, such as by staking, swaging over, or the like.

Actuator 72 is latched in its up or down position by a flux pattern from the respective permanent magnet, and is operated to the opposite position by energizing the single coil 82 with a selected polarity that will cancel the permanent magnet flux that was tending to maintain the plunger in its existing position and add to the magnetic flux of the opposite permanent magnet to attract the plunger to the opposite position. The direction can be reversed and the plunger returned to the original position by subsequent energization of the single coil 82 with a polarity opposite to the initial energization. In the contemplated alternative version desired operation is achieved by selective energization of a proper one of the two coils.

A non-magnetic hex head screw 90 extends through a clearance hole in upper frame member 88 and threads into a tapped hole in the upper end of plunger 80. An adjustable spring seat 92 is threaded onto the shank of screw 90. Spring seat 92 has an upstanding annular collar which positions and maintains separated two concentrically disposed helical compression springs 94 and 96. A platform insulator 98 is slidably disposed over the shank of screw 90, resting on springs 94 and 96. Insulator 98 has an upstanding integral sleeve **98*a* surrounding the opening therethrough for screw 90. Sleeve 98*a* projects into a central opening 70*a* in movable contact 70 to electrically insulate screw 90 from movable contact 70. An upper insulator washer 100 having a depending annular collar 100*a* is disposed around the shank of screw 90 at the upper surface of contact 70, the collar 100*a* telescopically extending along screw 90 into sleeve 98*a*. A washer 102 and the hexagonal head of screw 90 retain the entire movable contact assembly together. The axial position of screw 90 provides wear allowance adjustment for the contacts, while contact pressure adjustment is provided by the axial position of spring seat 92 on screw 90. Concentric springs 94 and 96 provide suppression of any resonant frequencies during vibration of the apparatus with the consequent elimination of undesirable motion of movable contact 70**.

Figure 7:
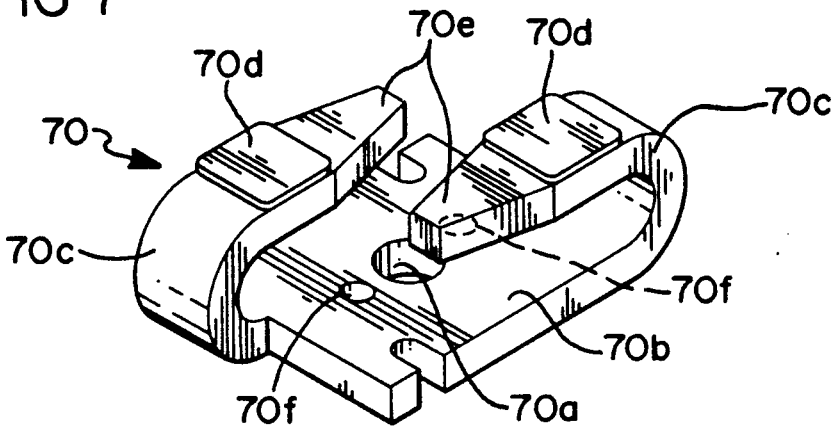
FIG. 7 is an isometric view of the movable contact of the DC switching apparatus of this invention.
Figure 8:
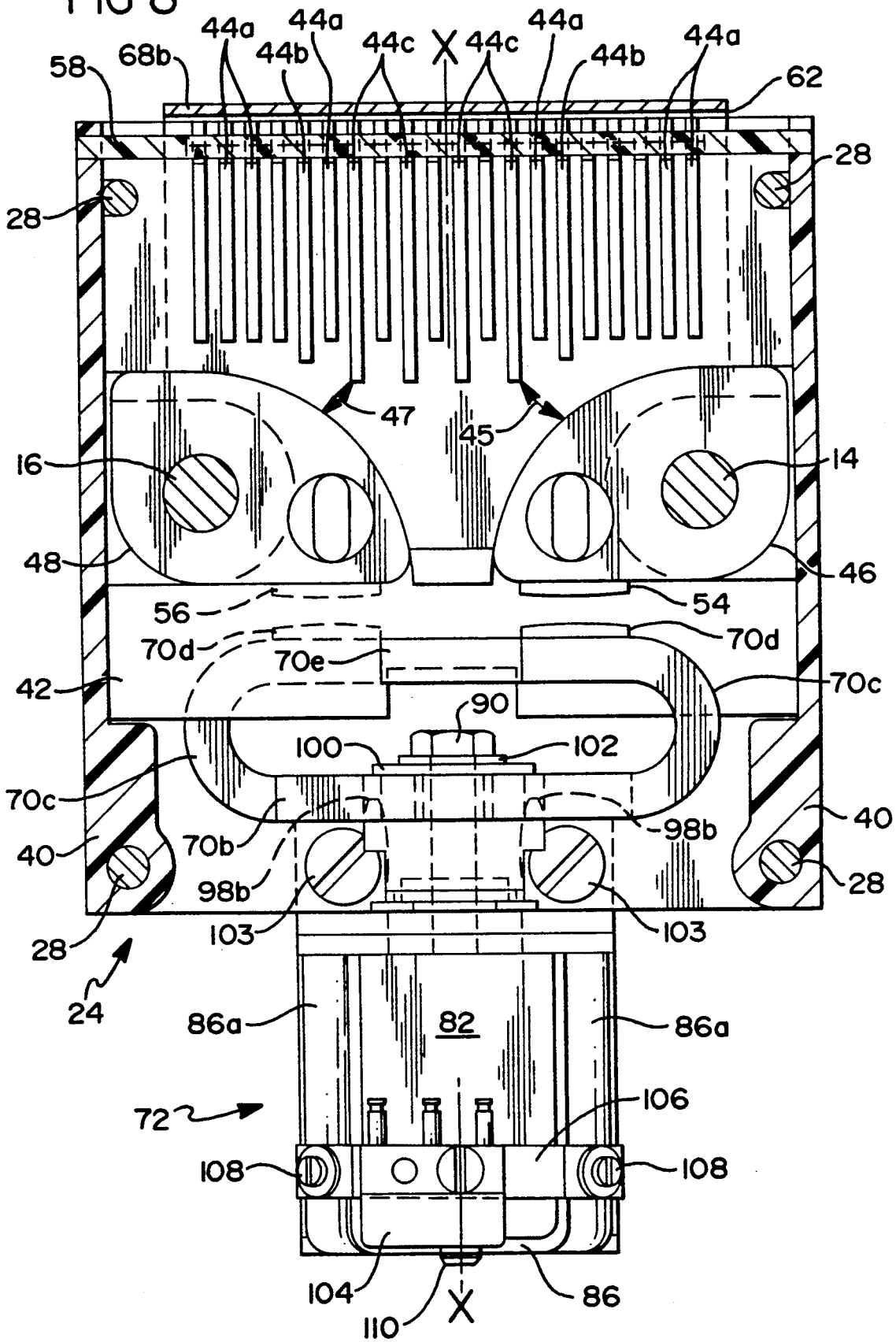
FIG. 8 is a cross section through one arc extinguishing chamber of this invention taken along the line 8—8 in FIG. 4.

As seen in FIG. 7, movable contact 70 comprises a flat base plate **70*b* of heavy gauge copper or the like in which central opening 70*a* is formed. Extending from opposite lateral ends of plate 70*b* are legs 70*c* which are offset one from the other front-to-rear and are curled upwardly in re-entrant bends wherein the distal ends of the legs are disposed centrally over plate 70*b*. A pair of contact elements 70*d* are affixed to the upper surface of each leg 70*c* by brazing or the like. The portion of each leg 70*c* extending beyond the contact elements 70*d* is beveled to approximate a converging point 70*e*. Base plate 70*b* is also provided with a pair of holes 70*f* located laterally on either side of opening 70*a*. Holes 70*f* cooperatively receive projections 98*b* (FIG. 8) on the upper surface of insulator 98 to maintain proper rotational alignment of movable contact 70 with respect to insulator 98, and the latter is provided with slots 98*c* along an edge thereof which receive upward projections 88*a* of upper frame member 88 to maintain insulator 98 properly rotationally oriented with respect to actuator 72 and the arc chambers. Actuator 72 is attached to the assembled arc extinguishing chamber assembly by screws 103 which pass through clearance holes in molding 40 and take into tapped holes in upstanding tabs 88*b* formed in upper steel frame member 88 (FIGS. 4 and 5**).

Plunger 80 of actuator 72 also functions to operate an auxiliary snap-action switch 104 which is attached to a pair of the legs **86*a* by a bracket 106 (FIG. 8) and screws 108. A non-magnetic button 110 is threadably attached to the lower end of plunger 80 and projects through a hole in lower frame member 86. A spring steel leaf 112 is mounted between a bracket 114 attached to the interior surface of header 8 (FIG. 3) and a tab 86*b* projecting from lower steel frame member 86 by a screw 116. Leaf spring 112 extends below frame member 86 across the end of button 110. The free end of spring leaf 112 is in alignment with an operator button of switch 104. When plunger 80 is in the lower position as shown in the drawings, button 110 holds leaf spring 112 depressed wherein the free end thereof is out of engagement with the operator button of switch 104. However, when plunger 80 is in its upper position, button 110 releases leaf spring 112 and the spring bias of that member operates switch 104**.

In operation of the DC switching apparatus of this invention, the single coil 82 (or the appropriate coil of a two-coil embodiment) of permanent magnet actuator 72 is appropriately energized by connections (not shown) from control electronics module 30 to transfer the plunger 80 to its uppermost position, thereby closing bridging contact 70 the stationary contacts 54 and 56. It will be appreciated that the offset arms **70*c* of movable contact 70 extend within the respective arc extinguishing chambers as seen in FIGS. 4 and 5. The apparatus herein disclosed through use of appropriate electronics in the module 30 may be used as a remote power controller or as an overload sensing and responsive circuit breaker or the like. Whatever manner in which the apparatus is used, an appropriate signal from the electronics module 30 to energize coil 82 in the opposite polarity will cause the actuator to move plunger 80 to its lowermost position, separating movable bridging contact 70 from stationary contacts 54 and 56**.

With reference to FIG. 9, let it be assumed that power terminal 14 is connected to the positive side of a high voltage DC power supply such as 250 amps, 270 volts, while power terminal 16 is connected to the negative side of that supply. The magnetic field across the arc chamber containing stationary contact 54 is directed out of the paper toward the viewer. Upon separation, an arc is drawn between stationary contact element 54 and movable contact element 70*d* and between the other movable contact element 70*d* and stationary contact 56. The positive potential arc at stationary contact 54 is represented by arrow 120 directed from the stationary contact to the movable contact. The arc at stationary contact 56 and movable contact 70*d* is represented by arrow 122 directed upwardly. The two arcs 120 and 122 tend to expand and the force applied by the magnetic field in the respective chambers moves the arc 120 leftward along the pointed extension 70*e* of movable contact 70 toward the conductor 48. The anode end of arc 120 at the stationary contact 54 and conductor 46 moves around a short radius corner of the conductor 46 toward the arc runner surface thereof. Because an anode end of an arc moves more readily than does a cathode end of the arc, it is preferable that the anode end be that which traverses the more irregular surface comprising the contact 54 and the conductor 46 and the cathode end move along the flat surface of the movable contact 70.

While arc 120 is lengthening and increasing the voltage thereof, arc 122 is also moving leftward under the bias of the magnetic field in the forward chamber but within a more confined area. The two arcs 120 and 122 establish additive arc voltages $V_{120}$ and $V_{122}$ seen in FIG. 11. The cumulative voltage of these two arcs is represented by $V_{120+122}$ in FIG. 11 which increases primarily as arc 120 (FIG. 9) lengthens by movement of the cathode end along movable contact 70 toward end 70*e*. During this time, the corresponding current $I_{120,122}$ decreases somewhat as shown in FIG. 12. Within a small interval of time, arc 120 attaches to the opposite teardrop shaped conductor 48 within the arc chamber common to stationary contact 54, establishing a current path through arc 120 from conductor 46 to conductor 48, and therefore from power terminal 14 to power terminal 16. Inasmuch as conductor 48 in the rear chamber is common and conductively connected to the conductor 48 in the forward chamber to which stationary contact element 56 is attached, the current path previously extending to the movable contact 70 from conductor 46 and from the movable contact 70 to conductor 48 is now eliminated and arc 122 is eliminated as well. Thereafter, a single arc 124 progresses along the arc runner surfaces of conductors 46 and 48 within the rearmost chamber upward into the splitter plates 44. As mentioned above, an arc generally moves more readily along its anode end than along its cathode end, and for this reason the anode end of arc 124 moves more quickly along the arc runner surface of conductor 46 and leads the cathode end thereof along the arc runner surface of conductor 48. As arc 124 moves along the arc runner surfaces and becomes lengthened, its voltage $V_{124}$ increases, thereby decreasing the current $I_{124}$ as shown in FIGS. 11 and 12. The larger gap 45 (FIG. 8) between the arc runner surface and splitter plates is located at the anode side of the chamber because of the aforementioned general characteristic of the anode end to be more readily movable than the cathode end. The arc 124 is first separated into intermediate length segments between the adjacent depending ends of splitter plates 44*c* and between 44*c* and 44*b* and thereafter is split into smaller lengths as these segments move into the smaller gaps between splitter plates 44*a* and the adjacent plates 44*a*, 44*b* or 44*c*. Once the arc is within the splitter plates, the voltage levels at $V_{EXT}$ in FIG. 11, driving the current $I_{124}$ to zero to interrupt the circuit.

The apparatus of this invention operates to establish an arc in each chamber between the respective stationary contact and the common movable bridging contact, then moves that arc in both chambers by magnetic fields applied by permanent magnets in reverse directions in the respective chambers. One of the arcs attaches to a spaced conductor which is conductively common with the stationary contact in the opposite chamber so as to establish a current path directly between the power terminals through the conductors and removing the current path from the movable contact, thereby eliminating the arc in one of the chambers. Thereafter the arc is moved upward into splitter plates to lengthen it and raise the voltage thereof, driving the current to zero and interrupting the circuit. In the event polarity at the power terminals is reversed, the two-chamber structure with reversely directed permanent magnet magnetic fields provided herein functions in the same manner, only the arc is eliminated in the rearmost chamber and extinguished in the forward chamber.

Referring next to FIG. 10, the particular structure and arrangement of the permanent magnets and the ferromagnetic flux return path are provided to drive the arc to a final stable position against an electromagnetically non-conductive side wall of the insulating arc chamber while it is still within the area of the splitter plates, retaining the arc in that area. This eliminates the need for providing a labyrinth of grooves for the upper ends of the splitter plates, simplifying construction, since the arc cannot extend beyond the end of the splitter plates and reestablish itself. As seen in FIG. 10, the upper edge of magnet 60*d* is disposed intermediate the upper and lower ends of splitter plates 44. However, the ferromagnetic flux return path comprising center plate 62, upper plate 68*b* and forward plate 64 provide a complete magnetic loop around the upper end of the arc chamber. Throughout the central area of the chamber, the magnetic field is directed straight across the chamber from magnet 60*d* through plate 64, upper plate 68*b* and center plate 62 across the chamber to magnet 60*d*. However, at the upper end of magnet 60*d*, the customary fringing of magnetic flux lines occurs. Such fringing is specifically directed in reverse loops by the presence of the ferromagnetic return path such that the upper flux lines turn back on themselves and return to the forward plate 64. This curvature of the flux pattern near the upper end of magnet 60*d* causes a curvature in the trajectory of the arc 124 as it moves from between the contacts 56 and 70*d* upward along the arc runner surface of conductors 46 and 48 and into the area of splitter plates 44. As the arc moves upward in the splitter plate area of the arc chamber, its trajectory, or path, curves more sharply to the right as seen in FIG. 10 until it impinges against the right-hand interior surface of the wall of molding 40, the wall surface and magnetic field preventing the arc from this final stable position from moving. To compensate for this repetitive occurrence of the arc at the final stable position, the wall of molding 40 is increased in thickness at 40*e* (FIG. 10) to absorb the heat of the arc and better withstand the erosion thereof.

The foregoing has described DC switching apparatus for high voltage DC power contained within a compact, light weight structure rendering it suitable for use in weight and volume sensitive applications, such as in aircraft use. The device has been made symmetrical for cost efficiency in manufacture and to enable it to be used as a non-polarized switching device to accommodate reversed polarity of the DC power. Although the device has been disclosed in a preferred embodiment, it is to be understood that it is susceptible of various modifications without departing from the scope of the appended claims.

We claim:

1. Direct current switching apparatus comprising:

a pair of arc extinguishing chambers each comprising a spaced pair of fixed conductors, respective conductors of one said chamber conductively connected to respective corresponding conductors of an other said chamber and to respective power terminals of said apparatus;

a first stationary contact conductively mounted on one of said conductors in said one chamber and a second stationary contact conductively mounted on an opposite one of said conductors in said other chamber; and a movable contact extending within each said chamber movable into and out of bridging engagement with said first and second stationary contacts, said movable contact establishing first and second arcs between said movable contact and said first and second stationary contacts, respectively, upon movement out of bridging engagement therewith, said first arc transferring from said movable contact to an opposite said conductor in said one chamber establishing a current path comprising said first arc directly between said respective spaced pair of conductors, eliminating said second arc.

2. The direct current switching apparatus defined in claim 1 wherein said arc extinguishing chambers comprise a plurality of arc splitter plates and said spaced pair of conductors in each said chamber comprise cooperating arc runners diverging toward said splitter plates, directing said first arc into said splitter plates wherein said arc is extinguished to interrupt current flow between said terminals.

3. The direct current switching apparatus defined in claim 2 wherein magnetic fields are provided across said chambers normal to said first and second arcs, polarity of said magnetic fields being predetermined with respect to current flow direction in said first arc to establish a magnetic force within said one chamber assisting movement of said first arc toward said opposite conductor in said one chamber.

4. The direct current switching apparatus defined in claim 3 wherein polarity of said magnetic field in said other chamber is reversed with respect to said polarity of said magnetic field in said one chamber, rendering operation and performance of said apparatus independent of reversal of direct current polarity at said power terminals.

5. The direct current switching apparatus defined in claim 4 wherein said magnetic fields are provided by permanent magnet means juxtaposed respective said chambers.

6. The direct current switching apparatus defined in claim 5 comprising ferromagnetic flux return paths disposed exteriorly around said respective chambers and permanent magnet means.

7. The direct current switching apparatus defined in claim 6 wherein said permanent magnet means cooperate with said ferromagnetic flux return path, directing a flux pattern of said magnetic field in a plurality of decreasing radius re-entrant loops near an end of said splitter plates, said magnetic field driving said first arc against an interior side wall of said chamber at a position within said splitter plates and maintaining said first arc stable at said position, preventing said first arc from traveling beyond said end of said splitter plates.

8. The direct current switching apparatus defined in claim 7 wherein said interior side wall of said chamber is increased in material thickness at said position.

9. Direct current switching apparatus comprising:

first and second arc extinguishing chambers each comprising a plurality of arc splitter plates and a pair of spaced arc runners;

means electrically interconnecting corresponding arc runners of each said chamber with a respective power terminal of said apparatus;

a first stationary contact mounted on one of said arc runners in said first chamber and a second stationary contact mounted on an opposite one of said arc runners in said second chamber; and a movable contact bridging said stationary contacts in a closed position and movable to an open position to separate said movable contact from said stationary contacts;

an arc drawn between said movable contact and said first stationary contact in said first chamber transferring from said movable contact to an other of said pair of spaced arc runners within said first chamber, said arc bridging said arc runners in said first chamber establishing a current path between said power terminals through respective said arc runners and said electrically interconnecting means in shunt of said movable contact, eliminating an arc in said second chamber.

10. The direct current switching apparatus defined in claim 9 comprising permanent magnet means juxtaposed said chambers providing magnetic fields across said chambers normal to an arc drawn between a respective said stationary contact and said movable contact, said magnetic fields directed to establish a magnetic force which is directed from one said arc runner having said stationary contact mounted thereon to the other said arc runner within a respective chamber, said magnetic force assisting movement of said arc drawn between said movable contact and said first stationary contact to bridge said pair of arc runners within said first chamber.

11. The direct current switching apparatus defined in claim 9 comprising a ferromagnetic flux return path disposed exteriorly of each respective said chamber and said juxtaposed permanent magnet means.

12. The direct current switching apparatus defined in claim 11 wherein said chambers each comprise an insulating housing containing said splitter plates, said pair of arc runners, and a respective one said stationary contact between opposed side walls of said housing, said permanent magnet means being disposed against an exterior surface of one of said side walls, and said ferromagnetic flux return path comprising at least one ferromagnetic plate disposed in a substantially magnetically continuous U-shape having one leg overlying said permanent magnet means at said one side wall and another leg adjacent an exterior surface of an opposite one of said side walls.

13. The direct current switching apparatus defined in claim 12 wherein said chambers are disposed with said opposite one of said side walls of each respective said chamber mutually adjacent.

14. The direct current switching apparatus defined in claim 11 wherein:

said chambers each comprise an insulating housing containing said splitter plates, said pair of arc runners, and a respective said one stationary contact between opposed sidewalls of said housing;

said permanent magnet means being disposed against an exterior surface of one of said walls of each said chamber;

said chambers being disposed with an opposite one of said side walls of each said chamber mutually adjacent; and said ferromagnetic flux return path comprising magnetically interconnected ferromagnetic plates overlying said permanent magnet means and a center plate of ferromagnetic material disposed between said mutually adjacent side walls of said chambers, said center plate also being magnetically interconnected with said ferromagnetic plates overlying said permanent magnet means and providing a flux path common to both said chambers.

15. The direct current switching apparatus defined in claim 14 wherein polarity of said magnetic field across said first chamber is reversed with respect to polarity of said magnetic field across said second chamber.

16. The direct current switching apparatus defined in claim 15 wherein operation of said apparatus is independent of polarity of direct current electric power connected to either respective power terminal of said apparatus, said permanent magnet fields always establishing a magnetic force in one or the other of said chambers which is directed from said one arc runner having said respective stationary contact to the other said arc runner within a respective chamber.

17. The direct current switching apparatus defined in claim 15 wherein said first chamber and said first stationary contact are determined by connection of the respective power terminal conductively interconnected therewith to a positive potential of direct current power supply, said apparatus thereby being operable independent of power polarity.

18. The direct current switching apparatus defined in claim 11 wherein said chambers each comprise an insulating housing having opposed interior side walls, said pair of arc runners being disposed between said interior side walls, said arc runners having cooperating surfaces diverging in a first direction; said interior side walls having grooves receiving lateral edges of said splitter plates positioning said splitter plates in a row extending transverse to said first direction, said splitter plates being longitudinally oriented in said first direction and spaced transversely to said first direction; said permanent magnet means being disposed on an exterior surface of one of said side walls and having an edge thereof intermediately juxtaposed opposite ends of said splitter plates, said ferromagnetic plate overlying said permanent magnet means extending therebeyond coextensive with said splitter plates accentuating fringing flux patterns of said magnetic field at said edge and establishing a magnetic force on said arc that drives said arc against an interior side wall surface within said row of splitter plates, preventing said arc from emerging said splitter plates.

19. The direct current switching apparatus defined in claim 11 wherein said chambers each comprise a hollow insulating housing having opposed interior side walls and being open at upper and lower edges thereof, said pair of arc runners being disposed between said interior side walls proximate said lower edge, said arc runners having cooperating surfaces diverging toward said upper edges, said interior side walls having grooves receiving lateral edges of said splitter plates positioning said splitter plates in a row substantially parallel with said upper edge, said grooves and said splitter plates being longitudinally oriented substantially perpendicular to said upper edge, said chamber further comprising an insulating cover member closing said open upper edge and defining with said housing vent openings at said upper edge.

20. The direct current switching apparatus defined in claim 19 wherein said grooves are open to said upper edge and said cover is disposed flush against an interior side wall containing said grooves, said grooves comprising said vent openings.

21. The direct current switching apparatus defined in claim 20 wherein said splitter plates have relieved upper corners adjacent said interior side wall defining a reservoir communicating with said vent openings.

22. The direct current switching apparatus defined in claim 20 wherein said cover comprises resilient means overlying upper edges of said splitter plates, biasing said splitter plates firmly against lower ends of said grooves.

23. The direct current switching apparatus defined in claim 19 wherein said ferromagnetic flux return path comprises a ferromagnetic plate overlying said vent openings in spaced relation thereto.

24. The direct current switching apparatus defined in claim 11 wherein said permanent magnet means and said ferromagnetic flux return path cooperatively define predetermined curvilinear distortion of said magnetic field within an area of said chamber containing said splitter plates, said magnetic field forcing said arc to a final stable arc position against a side wall of said chamber within said splitter plate area, preventing said arc from exiting said splitter plates.

25. The direct current switching apparatus defined in claim 24 wherein said housing side wall is increased in thickness at said final stable arc position.

26. The direct current switching apparatus defined in claim 11 wherein said splitter plates are non-ferromagnetic.

27. The direct current switching apparatus defined in claim 10 wherein said permanent magnet means comprise a plurality of permanent magnets, a first said permanent magnet disposed proximate a respective said stationary contact, second and third said permanent magnets disposed proximate ends of said arc runners closely adjacent said splitter plates, and a fourth said permanent magnet mutually disposed over said first, second and third magnets, polarization of said fourth permanent magnet being in series relationship with polarization of said first, second and third permanent magnets.

* * * * *